US009932814B2

(12) United States Patent
Harris et al.

(10) Patent No.: US 9,932,814 B2
(45) Date of Patent: Apr. 3, 2018

(54) METHOD AND APPARATUS FOR VIDEO VALIDATION

(71) Applicant: ABRADO INC., Houston, TX (US)

(72) Inventors: Marshal Harris, Houston, TX (US); Philip Schultz, Katy, TX (US); Alexander Esslemont, Houston, TX (US); Benny Silguero, Houston, TX (US); Paul Howlet, Aberdeen (GB)

(73) Assignee: Abrado, Inc., Houston, TX (US)

( * ) Notice: Subject to any disclaimer, the term of this patent is extended or adjusted under 35 U.S.C. 154(b) by 178 days.

(21) Appl. No.: 14/890,630

(22) PCT Filed: May 13, 2014

(86) PCT No.: PCT/US2014/037787

§ 371 (c)(1),
(2) Date: Nov. 12, 2015

(87) PCT Pub. No.: WO2014/186327

PCT Pub. Date: Nov. 20, 2014

(65) Prior Publication Data

US 2016/0084067 A1 Mar. 24, 2016

Related U.S. Application Data

(60) Provisional application No. 61/822,499, filed on May 13, 2013.

(51) Int. Cl.

| | |
|---|---|
| ***H04N 9/47*** | (2006.01) |
| ***H04N 7/18*** | (2006.01) |
| ***E21B 47/00*** | (2012.01) |

(52) U.S. Cl.
CPC ..... *E21B 47/0002* (2013.01)

(58) Field of Classification Search
CPC ..... E21B 47/0002
USPC ..... 348/85
See application file for complete search history.

(56) References Cited

U.S. PATENT DOCUMENTS

| | | | | |
|---|---|---|---|---|
| 5,652,617 A * | 7/1997 | Barbour | E21B 47/0002 | 348/85 |
| 5,811,894 A * | 9/1998 | Buyers | E21B 43/1185 | 200/82 A |
| 2004/0000406 A1* | 1/2004 | Allamon | E21B 21/103 | 166/373 |
| 2013/0112401 A1* | 5/2013 | Guerrero | E21B 41/0085 | 166/244.1 |

* cited by examiner

*Primary Examiner* — Hung Dang
*Assistant Examiner* — Girumsew Wendmagegn
(74) *Attorney, Agent, or Firm* — Ted M. Anthony

(57) ABSTRACT

A validation tool (100) has a central body member (10) with threaded connections at each end (12, 13), as well as a central bore (11) extending there through. At least one battery powered video camera (20) or other optical data sensor is disposed along an outer surface of the body member and can be selective activated and de-activated. Optional mirror(s) (50) are provided to permit optimum viewing of the surrounding environment, while visual images and/or other sensed data is recorded and stored on at least one data storage media. The validation tool can be used for various purposes including wellbore integrity and verification that drilling mud has been fully displaced with completion fluid in a wellbore.

17 Claims, 8 Drawing Sheets

METHOD AND APPARATUS FOR VIDEO VALIDATION

BACKGROUND OF THE INVENTION

1. Field of the Invention

The present invention comprises a video camera or other data acquisition assembly that can be used in downhole environments including, without limitation, in oil and or gas wells. More particularly, the present invention comprises a video camera or other data acquisition assembly that can be installed in a well in order to confirm or validate certain well conditions including, without limitation, structural and equipment integrity, debris and the condition and quality of fluid in a well.

2. Brief Description of the Prior Art

During drilling operations, wells are typically filled with a fluid known as drilling mud, which is also sometimes referred to as drilling fluid; although compositions can vary, such drilling mud frequently includes high concentrations of clays, barites or other solids. In many cases, such drilling mud is pumped down the longitudinally extending bore of drill pipe or other tubular string, and then circulated up the annular space formed between the external surface of said drill pipe and the internal surface of the surrounding casing or open hole wellbore. Such drilling mud serves a variety of functions including, without limitation, to cool and lubricate drill bits and other downhole equipment; to transport pieces of drilled-up rock and other debris from the bottom of a well to the surface; to provide hydrostatic pressure to control encountered subsurface pressures; and to seal porous rock formations with a substantially impermeable filter cake.

After a well has been drilled to a desired depth and casing has been installed, the well is typically completed in one or more producing reservoirs. Prior to such completion operations, the drilling mud (together with any associated drill cuttings, cement pieces and/or other debris) is typically removed from a well and replaced with substantially clear completion fluid, which is typically a weighted brine or other similar liquid. A "clean" wellbore generally promotes a successful completion process and enhanced production/injection performance by minimizing or eliminating fine solids commonly found in drilling mud and are potentially damaging to hydrocarbon producing reservoirs. A "clean" wellbore also minimizes mechanical failures such as packed screens and stuck valves.

Efficient and comprehensive wellbore cleanout ("WBC") is fundamental to the success of a well completion process, especially in oil and gas wells located offshore or in deep-water or other challenging environments. Such wells typically require a comprehensive wellbore cleanout service to ensure that all drilling mud, cement and/or other debris are fully removed from a well prior to installing expensive and complex completion equipment. Conventional wellbore cleanout operations typically involve a combination of abrasive brushes, scrapers, magnets or other mechanical tools, together with specially designed displacement chemicals.

Currently, the only means of validating the cleanliness of a wellbore and the effectiveness of the fluid displacement process is to run a mechanical debris retrieval tool with a gauge ring, typically on wire line, multiple times until the tool returns to the surface "empty" (that is, with no debris visible). Secondary measures include monitoring and testing of fluid return characteristics. None of these approaches are totally reliable or accurate, and often incorrectly indicate that a wellbore has been cleaned sufficiently, allowing residual drilling mud, cement or other debris to remain within said wellbore. Because this fact is widely known, multiple pipe and wireline trips, and excessive fluid circulation, is typically practiced in order to clean out the wellbore.

Verification of wellbore fluid displacement and resultant "cleanliness" is critically important because it can greatly reduce or eliminate the likelihood of unnecessary pipe or wireline trips in and out of a well. Such unnecessary trips can be extremely expensive, particularly on rigs operating in deep water environments or other remote locations. In addition to economic concerns, such unnecessary pipe or wireline trips create additional safety hazards for personnel. By eliminating unnecessary trips, and especially pipe trips, safety hazards can be significantly mitigated. Alternatively a surface readout or memory downhole video camera could be lowered into the wellbore after the clean out assembly has been pulled from the well to provide this inspection. Albeit this would require 12-24 additional hours or more to complete. In deep water operations this time would increase the cost of the well by as much as $1,000,000, typically not considered an acceptable cost Thus, there is a need for a means for efficiently and accurately confirming and validating cleanliness of a wellbore including, without limitation, following displacement of drilling mud with completion fluid.

SUMMARY OF THE INVENTION

The validation tool of the present invention utilizes recorded video or other optical images to verify cleanliness and other characteristics of a wellbore without the need to remove an entire drill string from said wellbore. The validation tool of the present invention can confirm various downhole conditions including, without limitation, fluid cleanliness, presence of bypassed debris, plug retrievability, equipment orientation, riser integrity and/or blowout preventer assembly integrity. Further, the validation tool of the present invention eliminates non-productive time spent unnecessarily running pipe and/or wireline in and out of a wellbore, resulting in cost savings and increased safety.

In a preferred embodiment, the validation tool of the present invention comprises a substantially tubular body member having threaded connections at each end, as well as a central through-bore extending though said body member. Said validation tool can be included at any point within a tubular workstring inserted into a well such as, for example, a wellbore clean out assembly conveyed on drill pipe.

At least one battery powered video camera or other optical data sensor is disposed along an outer surface of said body member. Optional mirrors can be provided along an angled outer surface of said body member to permit viewing of wellbore sections in the vicinity of said validation tool, while a least one light source can be provided to illuminate desired portions of said wellbore environment. In a preferred embodiment, said at least one video camera or other data sensor can be selectively activated and de-activated when desired. Visual images or other data sensed by said validation tool is recorded on at least one data storage means for downloading and/or direct viewing/observation following removal of said validation tool from said wellbore.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

The application on which this application claims priority, U.S. Provisional Patent Application No. 61/822,499, filed May 13, 2013, is hereby incorporated herein by reference in its entirety.

Figure 1:
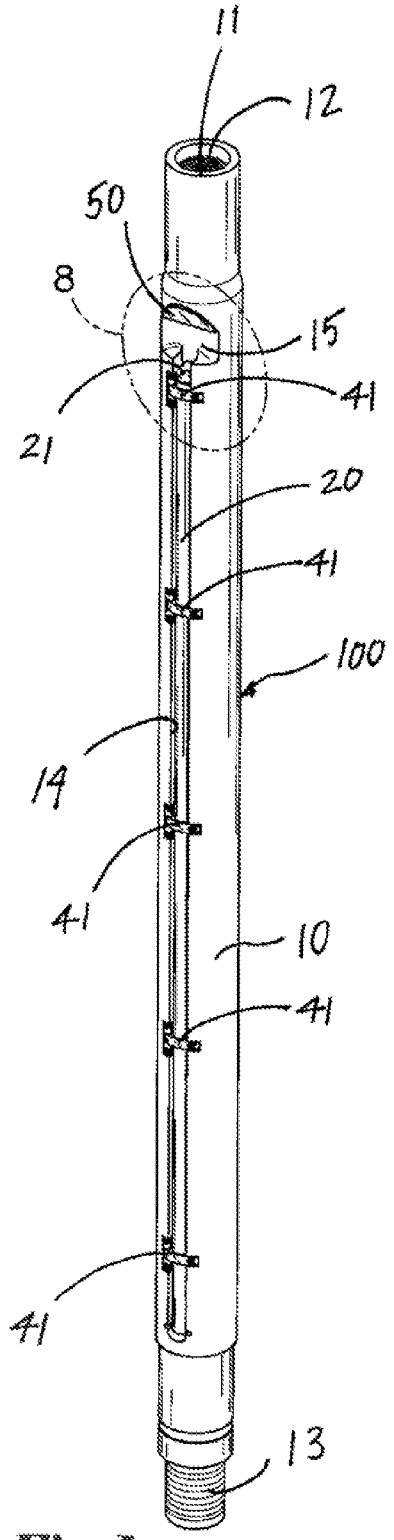
FIG. 1 depicts a side perspective view of a validation tool of the present invention.

FIG. 1 depicts a side perspective view of a validation tool 100 of the present invention. In a preferred embodiment, validation tool 100 comprises a substantially tubular body member 10, also sometimes referred to as a carrier member, having a central through-bore 11 extending though said body member 10 along the longitudinal axis of said body member 10. A threaded box end connection member 12 is disposed at one end of said body member 10, while a threaded pin end connection member 13 is disposed at the opposite end of said body member 10. Following convention in the oil and gas industry, threaded connection members 12 and 13 can be used to include validation tool 100 within a tubular workstring inserted into a well such as, for example, a wellbore clean out assembly conveyed on drill pipe.

Still referring to FIG. 1, a first elongate groove 14 is formed in an exterior surface of body member 10, and is oriented substantially parallel to the longitudinal axis of said body member 10 (and central through bore 11). Said first elongate groove 14 is recessed relative to the outer surface of body member 10. Upper mirror indention 15, also recessed relative to the outer surface of body member 10, is disposed near the upper end of first elongate groove 14.

First camera assembly 20 having lens 21 is mounted within first elongate groove 14 and secured in place using at least one clamp member 41. Said lens 21 is generally directed toward upper mirror indention 15. More specifically, lens 21 is directed toward first (upper) mirror 50 which, in turn, is mounted within said upper mirror indention 15.

Figure 2:
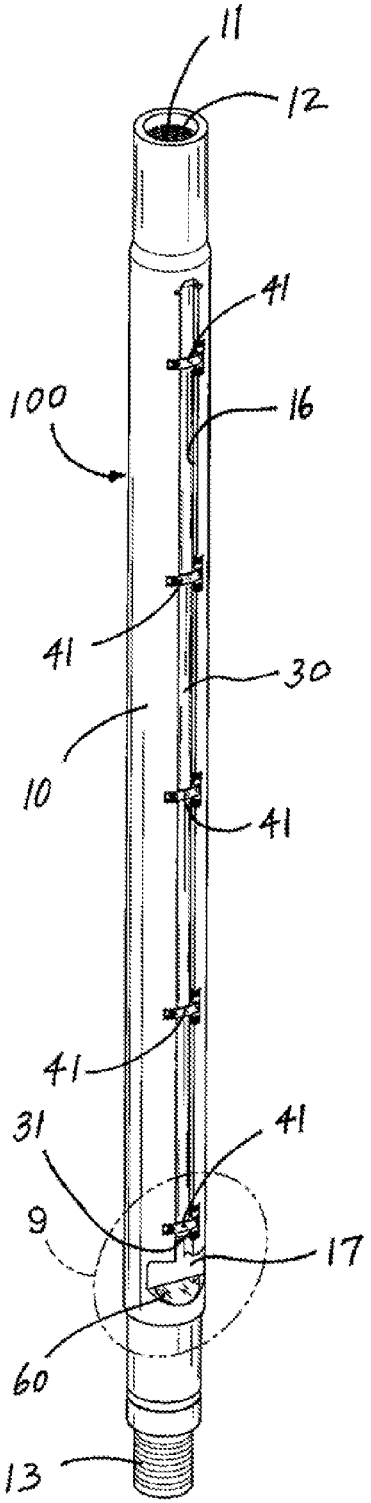
FIG. 2 depicts a side perspective view of a validation tool of the present invention depicted in FIG. 1 rotated about its longitudinal axis.

FIG. 2 depicts a side perspective view of validation tool 100 of the present invention depicted in FIG. 1, partially rotated about its longitudinal axis. Second elongate groove 16 is formed in an exterior surface of body member 10, and is oriented substantially parallel to the longitudinal axis of said body member 10 (and central through bore 11). Said second elongate groove 16 is recessed relative to the outer surface of body member 10. Lower mirror indention 17, also recessed relative to the outer surface of body member 10, is disposed near the lower end of second elongate groove 16.

Second camera assembly 30 having lens 31 is mounted within second elongate groove 16 and secured in place using at least one clamp member 41. Said lens 31 is generally directed toward lower mirror indention 17. More specifically, lens 31 is directed toward second (lower) mirror 60 which, in turn, is mounted within said lower mirror indention 17.

Figure 3:
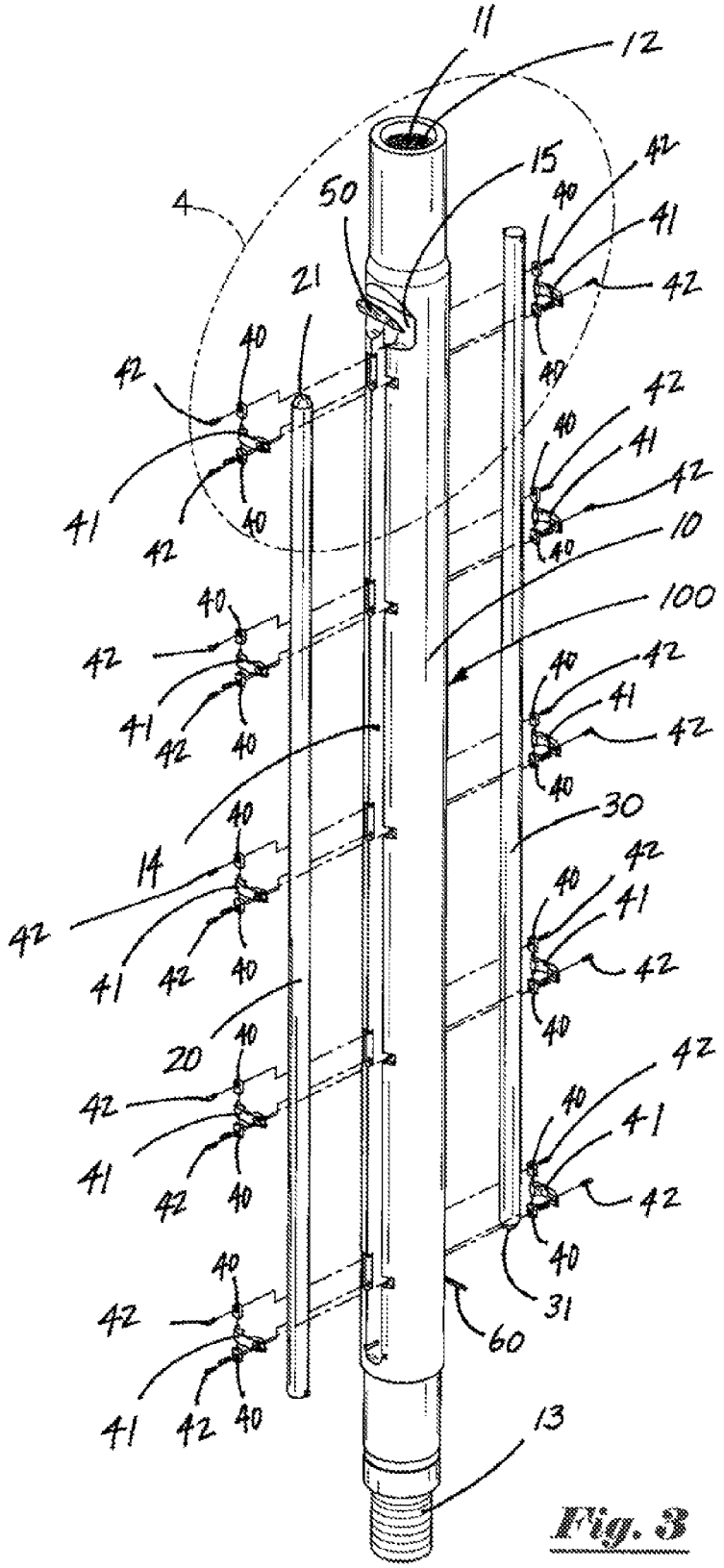
FIG. 3 depicts an exploded side perspective view of a validation tool of the present invention.

FIG. 3 depicts an exploded side perspective view of validation tool 100 of the present invention. Validation tool 100 comprises substantially tubular body member 10 having central through-bore 11, threaded box end connection member 12 and threaded pin end connection member 13. First elongate groove 14 is formed in an exterior surface of body member 10. Upper mirror indention 15 is disposed near the upper end of first elongate groove 14.

First camera assembly 20 having lens 21 is mounted within first elongate groove 14 and secured in place using at clamp members 41. Clamp members 41 are, in turn, mounted within hinge retainers 40 and attached to body member 10 using set screws 42. Lens 21 is generally directed toward first (upper) mirror 50 which, in turn, is mounted within said upper mirror indention 15.

Similarly, second elongate groove 16 (not visible in FIG. 3) is formed in body member 10; in a preferred embodiment, said second elongate groove 16 is phased 180 degrees around the circumference of body member 10 relative to first elongate groove 15. Second camera assembly 30 having lens 31 is mounted within second elongate groove 16 and secured in place using at least one clamp member 41. Clamp members 41 are, in turn, mounted within hinge retainers 40 and attached to body member 10 using set screws 42. Lens 31 is directed toward second (lower) mirror 60.

Figure 4:
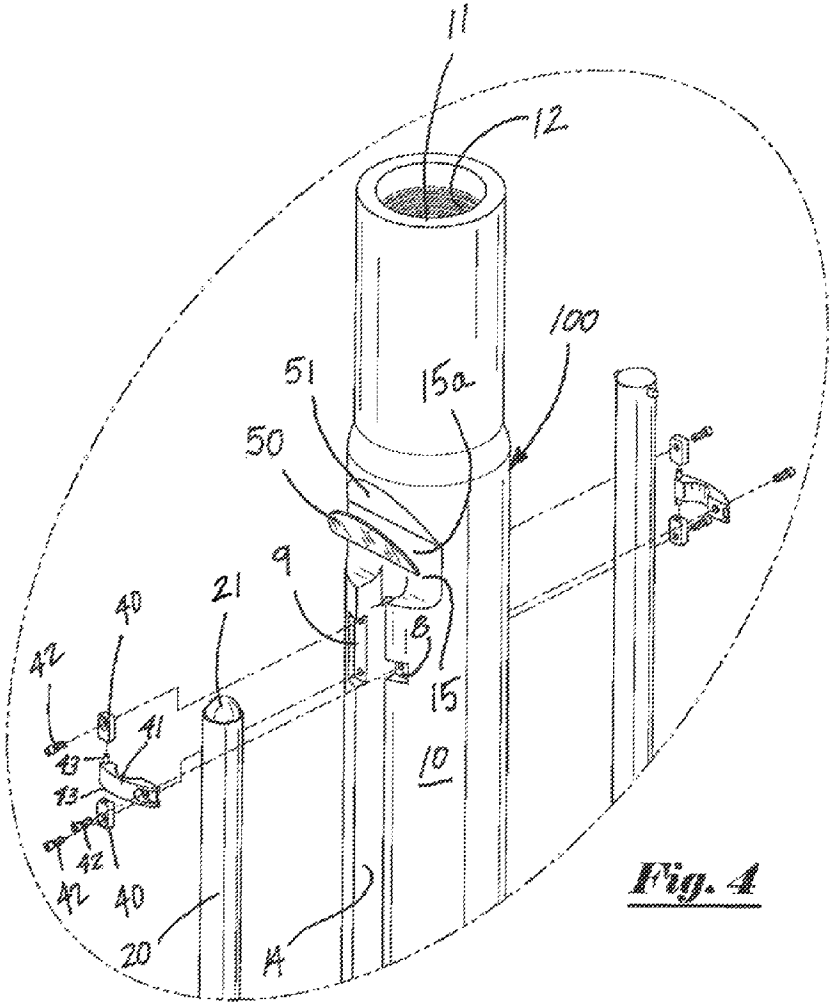
FIG. 4 depicts a detailed view of a highlighted portion of a validation tool of the present invention depicted in FIG. 3.

FIG. 4 depicts a detailed view of a highlighted portion of validation tool 100 of the present invention depicted in FIG. 3. Validation tool 100 comprises substantially tubular body member 10 having central through-bore 11 and threaded box end connection member 12 having internal threads. First elongate groove 14 is formed in an exterior surface of body member 10, with upper mirror indention 15 disposed at the upper end of first elongate groove 14.

First camera assembly 20 having lens 21 is mounted within first elongate groove 14 and secured in place using clamp members 41. Specifically, hinge retainers 40 are mounted to body member 10 within hinge mounting recess 9 using set screws 42. Clamp members 41 are pivotally mounted to said hinge retainers 40 using hinge pins 43 and secured to body member 10 in clamp mounting recess 8 using set screw 42. Lens 21 is generally directed toward first (upper) mirror 50 which, in turn, is mounted within said upper mirror indention 15. In a preferred embodiment, mirror 50 is disposed on a mounting shoulder 51; said mounting shoulder 51 beneficially oriented at an acute angle relative to the planar surface 15*a* of upper mirror indention 15. In a preferred embodiment, said acute angle is approximately 45 degrees, but can be varied or adjusted to satisfy particular wellbore configurations or conditions.

Figure 5A:
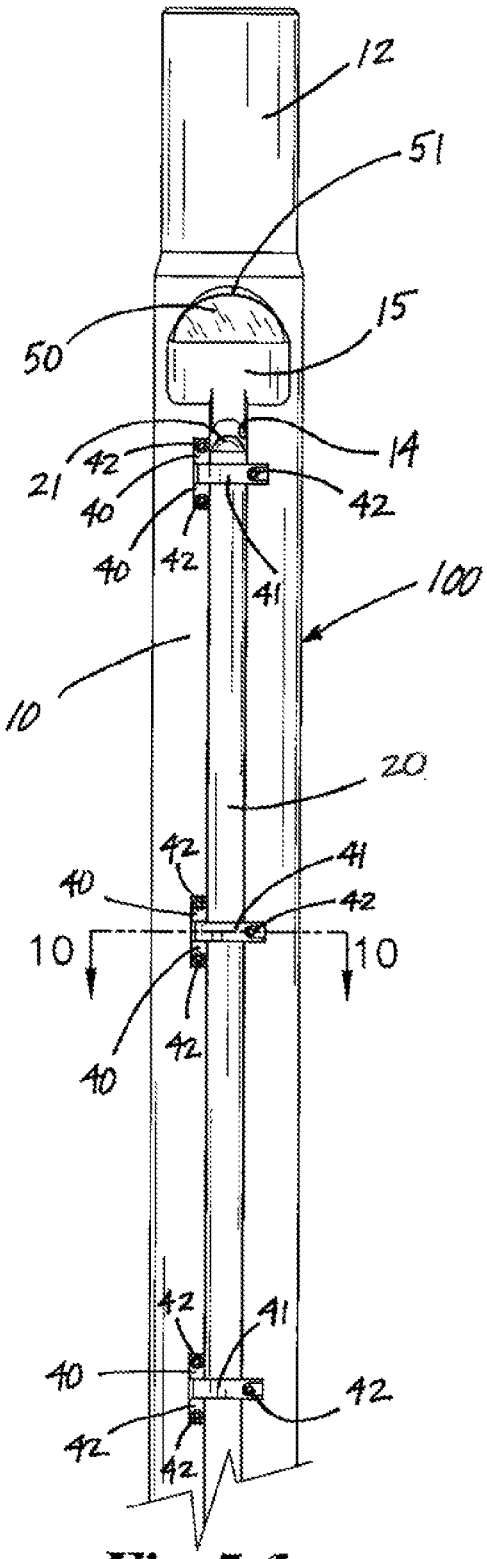
FIG. 5A depicts a side view of a portion of a validation tool of the present invention.
Figure 5B:
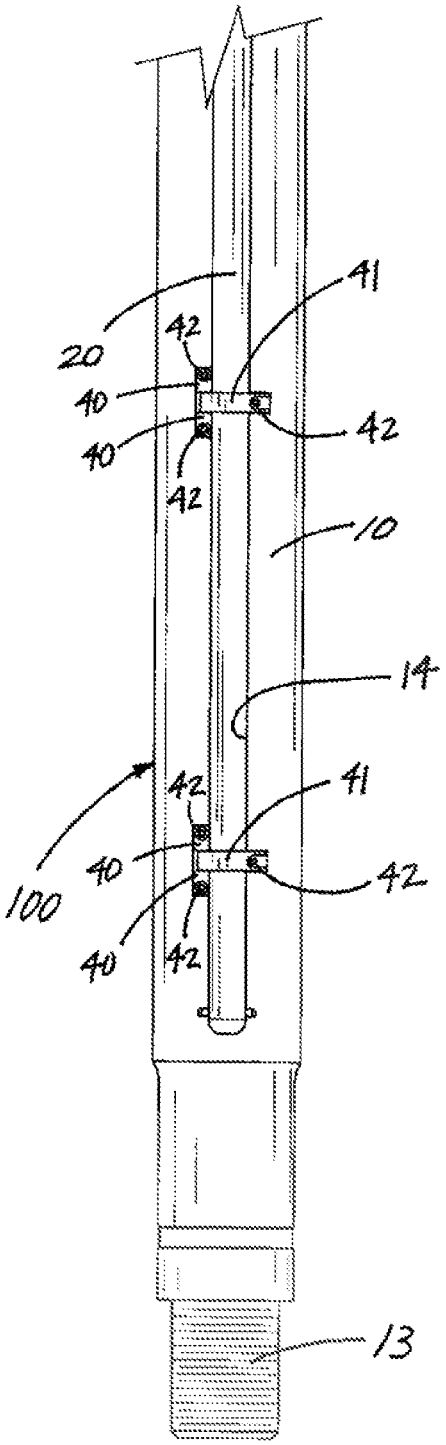
FIG. 5B depicts a side view of a portion of a validation tool of the present invention.

FIG. 5A depicts a side view of an upper portion of validation tool 100 of the present invention, while FIG. 5B depicts a side view of a lower portion of validation tool 100 of the present invention. Validation tool 100 comprises substantially tubular body member 10 having threaded box end connection member 12 and threaded pin end connection member 13. First elongate groove 14 is formed in an exterior surface of body member 10, with upper mirror indention 15 disposed near the upper end of first elongate groove 14. First camera assembly 20 having lens 21 is mounted within first elongate groove 14 and secured in place using clamp members 41. Hinge retainers 40 are mounted to body member 10 with set screws 42, while clamp members 41 are pivotally mounted to said hinge retainers 40 and secured to body member 10 using set screw 42. Lens 21 is generally directed toward first (upper) mirror 50 which is mounted on shoulder 51.

Figure 6A:
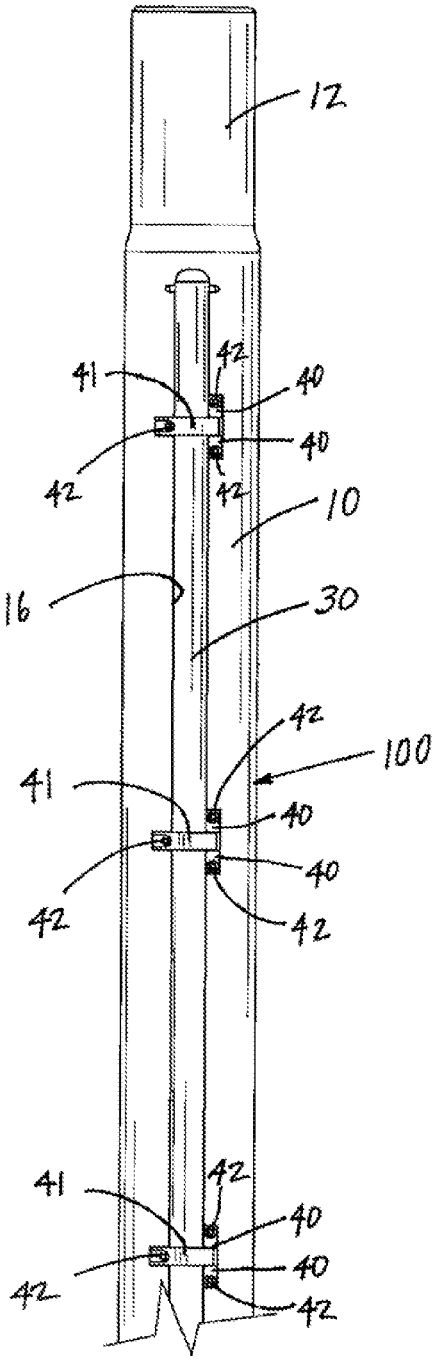
FIG. 6A depicts a side view of a portion of a validation tool of the present invention.
Figure 6B:
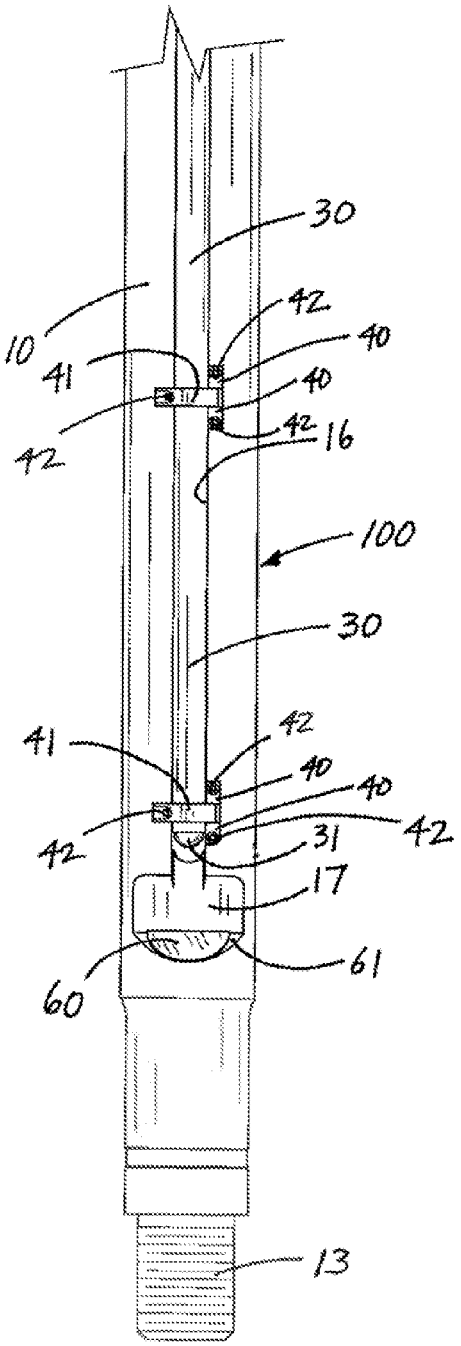
FIG. 6B depicts a side view of a portion of a validation tool of the present invention.

FIG. 6A depicts a side view of an upper portion of validation tool 100 of the present invention, while FIG. 6B depicts a side view of a lower portion of validation tool 100 of the present invention. FIG. 6A and FIG. 6B are phased 180 degrees around the circumference of body member 10 relative to the orientation of validation tool 100 depicted in FIG. 5A and FIG. 5B.

Validation tool 100 comprises substantially tubular body member 10 having threaded box end connection member 12 and threaded pin end connection member 13. Second elongate groove 16 is formed body member 10, with lower mirror indention 17 disposed near the lower end of second elongate groove 16. Second camera assembly 30 having lens 31 is mounted within second elongate groove 16 and secured in place using clamp members 41, hinge retainers 40 and set screws 42. Lens 31 is generally directed toward second (lower) mirror 60 which is mounted on shoulder 61.

Figure 7A:
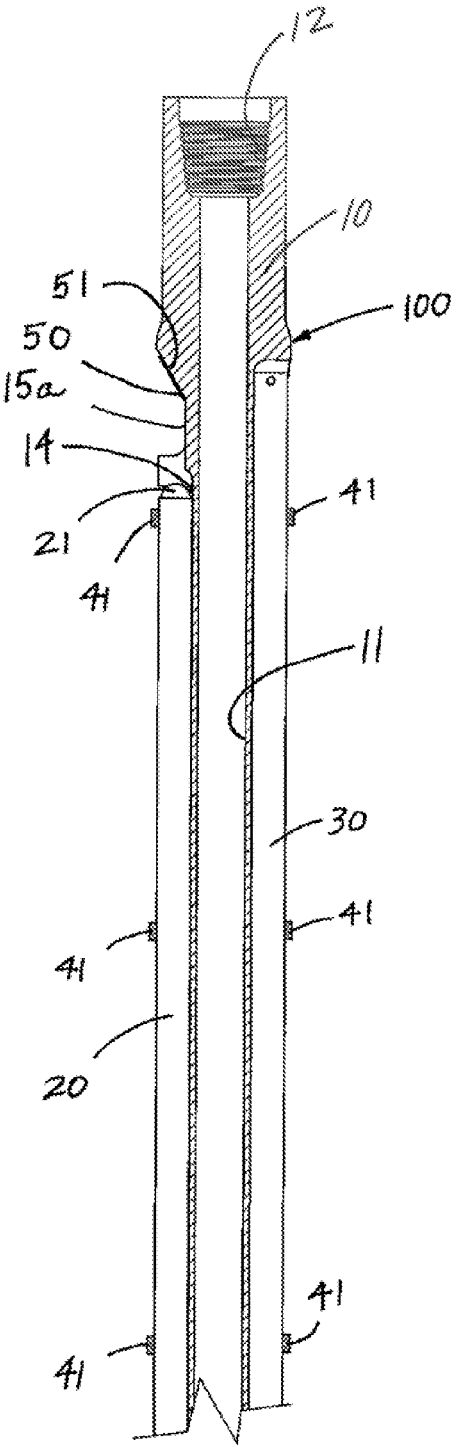
FIG. 7A depicts a side sectional view of a portion of a validation tool of the present invention.
Figure 7B:
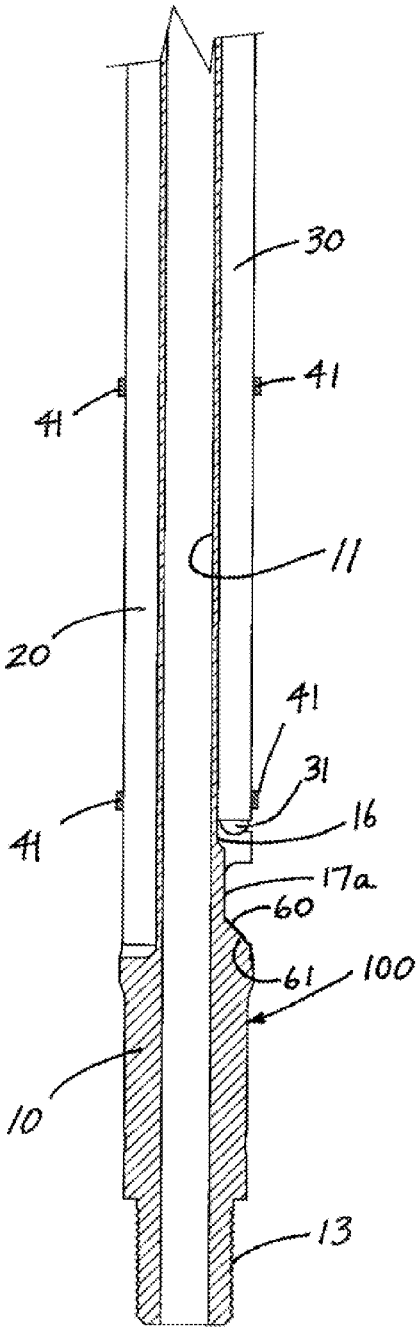
FIG. 7B depicts a side sectional view of a portion of a validation tool of the present invention.

FIG. 7A depicts a side sectional view of an upper portion of validation tool 100 of the present invention, while FIG. 7B depicts a side sectional view of a lower portion of validation tool 100 of the present invention. Validation tool 100 comprises a substantially tubular body member 10, also sometimes referred to as a carrier member, having a central through-bore 11 extending though said body member 10 along the longitudinal axis of said body member 10. A threaded box end connection member 12 is disposed at one end of said body member 10, while a threaded pin end connection member 13 is disposed at the opposite end of said body member 10.

First elongate groove 14 is formed in an exterior surface of body member 10, with an upper mirror indention having substantially planar surface 15*a* disposed near the upper end of first elongate groove 14. First camera assembly 20 having lens 21 is mounted within first elongate groove 14 and secured in place using clamp members 41. Lens 21 is generally directed toward first (upper) mirror 50, mounted on shoulder 51, which is oriented at an acute angle relative to substantially planar surface 15*a*. In a preferred embodiment depicted in FIG. 7A, said angle is approximately 45 degrees.

Second elongate groove 16 is formed body member 10, with a lower mirror indention having substantially planar surface 17*a* disposed near the lower end of second elongate groove 16. Second camera assembly 30 having lens 31 is mounted within second elongate groove 16 and secured in place using clamp members 41. Lens 31 is generally directed toward second (lower) mirror 60 which is mounted on shoulder 61 which is oriented at an acute angle relative to substantially planar surface 17*a*.

As depicted in FIGS. 7A and 7B, camera 20 is phased approximately 180 degrees from camera 30 around the circumference of body member 10. It is to be observed that the number of camera assemblies disposed around body member 10 can be varied depending upon operational variables and other considerations and is not limited to two cameras as depicted in the appended drawings. By way of illustration, but not limitation, it is possible that four camera assemblies can be employed and disposed at approximately 90 degree phasing relative to each other around the circumference of body member 10.

Figure 8:
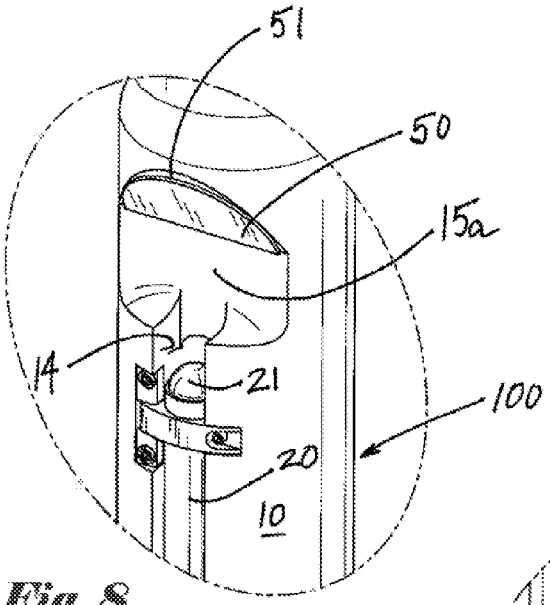
FIG. 8 depicts a detailed view of a highlighted portion of a validation tool of the present invention.

FIG. 8 depicts a detailed view of a highlighted portion of validation tool 100 of the present invention. First elongate groove 14 is formed in an exterior surface of body member 10, with an upper mirror indention having substantially planar surface 15*a* disposed near the upper end of first elongate groove 14. First camera assembly 20 having lens 21 is mounted within first elongate groove 14. Lens 21 is generally directed toward first (upper) mirror 50, mounted on shoulder 51, which is oriented at an acute angle relative to substantially planar surface 15*a*.

Figure 9:
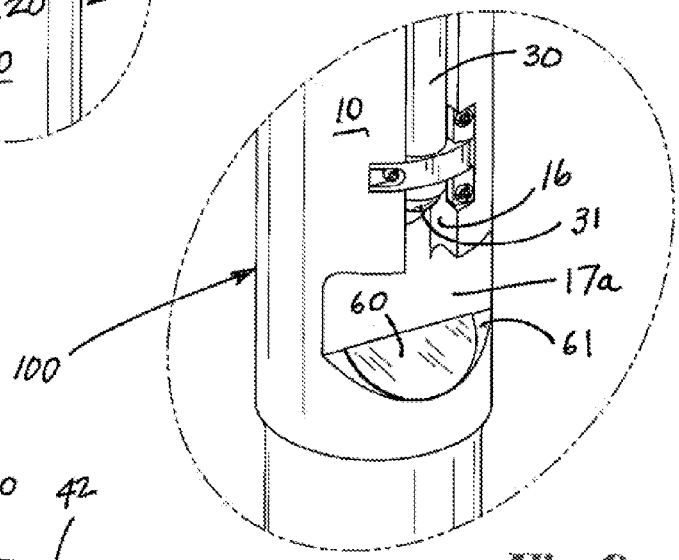
FIG. 9 depicts a detailed view of a highlighted portion of a validation tool of the present invention.

FIG. 9 depicts a detailed view of a highlighted portion of validation tool 100 of the present invention. Second elongate groove 16 is formed body member 10, with a lower mirror indention having substantially planar surface 17*a* disposed near the lower end of second elongate groove 16. Second camera assembly 30 having lens 31 is mounted within second elongate groove 16. Lens 31 is generally directed toward second (lower) mirror 60, mounted on shoulder 61 which is oriented at an acute angle relative to substantially planar surface 17*a*. In a preferred embodiment, said acute angle is approximately 45 degrees.

Figure 10:
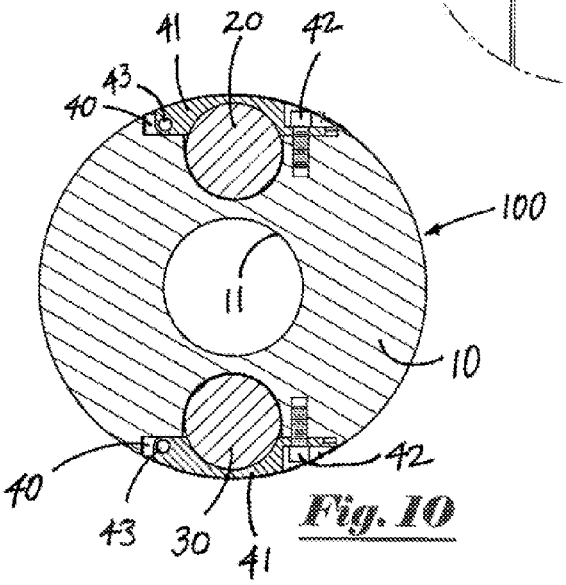
FIG. 10 depicts a cross sectional view of the validation tool of the present invention along line 10-10 of FIG. 5A.

FIG. 10 depicts a cross sectional view of validation tool 100 of the present invention along line 10-10 of FIG. 5A. Validation tool 100 has body section 10 and central through bore 11. Camera 20 is phased approximately 180 degrees from camera 30 around the circumference of body member 10. Hinge retainers 40 are mounted to body member 10 with set screws 42, while clamp members 41 are pivotally mounted to said hinge retainers 40 using hinge pins 43 and secured to body member 10 using set screw 42.

Figure 11:
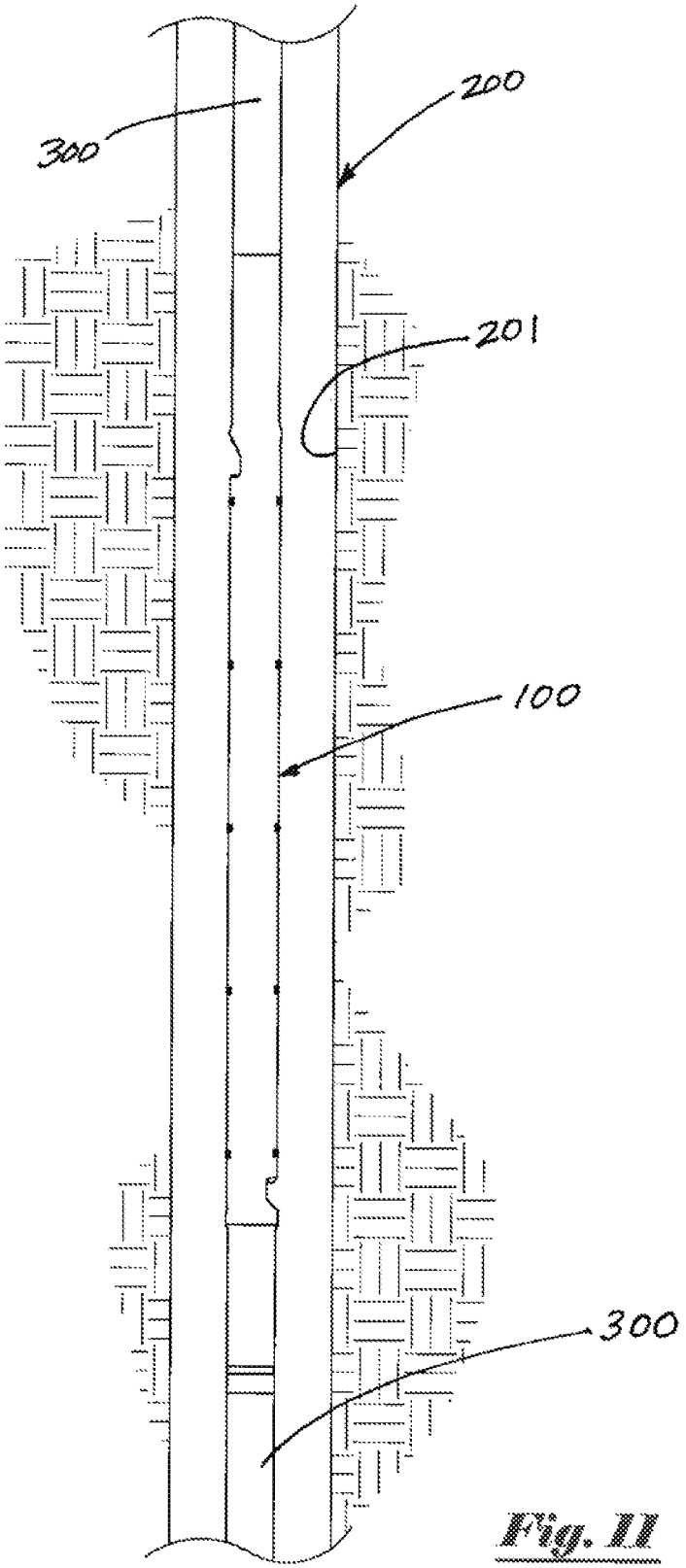
FIG. 11 depicts a side sectional view of the validation tool of the present invention installed within a wellbore.

FIG. 11 depicts a side sectional view of validation tool 100 of the present invention installed within a wellbore 200 having inner surface 201. Mirrors 50 and 60 permit viewing of wellbore 200 (and, more particularly, inner surface 201 thereof) in the vicinity of said validation tool 100, while a least one light source can be provided to illuminate desired portions of said wellbore environment. In a preferred embodiment, video cameras 20 and 30 (or other data sensors) can be selectively activated and de-activated when desired. Visual images or other data sensed by said validation tool 100 is recorded on at least one data storage means for downloading and/or direct viewing/observation following removal of said validation tool from said wellbore.

Viewing areas for each camera lens requires illumination for proper video or optical data capture. Illumination is achieved by one, or a combination of, the following:

light emitting diodes ("LED's") positioned to illuminate each camera lens field of view directly;

LED(s) coupled to a fiber bundle terminating at fiber lens receptacles positioned to illuminate each camera lens field of view;

Halogen bulb(s) positioned to illuminate each camera lens field of view directly; or Halogen bulb(s) coupled to a fiber bundle terminating at fiber lens receptacles positioned to illuminate each camera lens field of view.

Further, it is to be observed that any of these light sources may optionally pass through light diffusion media to improve illumination characteristics of a particular area.

In a preferred embodiment, validation tool 100 of the present invention permits 360 degrees of viewing around the outer circumference of said tool (and the inner surface 201 of wellbore 200). The number of cameras is typically dependent upon tool size, lens type, and lens orientation which may be customized. The cameras can be focused perpendicular to the validation tool body or, in a preferred embodiment, angled slightly downward to allow for ease of event/object identification within the wellbore. Ideally high definition video at thirty (30) frames per second is recorded and retrievable as said validation tool is retrieved from a wellbore and reaches the surface. Each of said cameras may act independently (saving data independently and using a dedicated power source) or may share memory and power resources.

Although not depicted in FIG. 11, it is to be observed that a plurality of stacked validation tools 100 can be included within one string of pipe. For example, when three (3) validation tools are installed, a first validation tool can be located at or near total depth, a second validation tool can be located at or near a mudline, perforations or mid-range areas of interest, and a third validation tool can be located at or near a BOP assembly, wellhead assembly or other subsea structure.

Conventional downhole cameras and other similar tools are typically activated by pre-programming such equipment to turn on relative to a time lapse constant or in synch with an internal clock. However, oil and gas operations are inherently unpredictable, and operations rarely fit a predetermined schedule. For this reason, activation by means of a time lapse constant or an internally synced clock is not practical for such operations.

By contrast, validation tool 100 of the present invention can be selectively activated using at least one, or a combination, of the following methods:

Time synch or time lapse coordinated with a clock internal to the camera assembly, or a computer having a data processor (such as a PC), including at the earth's surface;

A ball or other object can be dropped into the central through bore of the validation assembly in order to land on a seat and form a fluid seal. Fluid pressure can be increased above said seated ball or object. Said increased fluid pressure can shift a sleeve mechanism within said camera assembly, or trigger another actuation mechanism, in order to activate said camera assembly. Said seat can include an optional shearing capability wherein additional fluid pressure above a predetermined level can cause said seat to shift in said through bore, thereby permitting fluid to flow through said through bore;

An RFID chip can pumped or otherwise passed in proximity to said validation assembly. An RFID sensor can sense the presence of said RFID chip, triggering an actuation switch in order to activate said camera assembly;

A plurality of conductive points can be provided. A high-conductivity fluid can be pumped down said central through bore or otherwise disposed at said validation assembly. Said high-conductivity fluid completes an electrical circuit, thereby triggering a switch and activating said camera assembly;

Mechanical manipulation or wireless signaling using a wireline (for example, braided, slickline or electric line) deployed actuation device;

Wireless activation using a pump-through wireless tool;

Fluid pressure activation using fluid pumped through the central through bore of said tubular string and/or camera assembly;

Setting down tubular string weight on the validation tool;

Using acid or corrosive fluid to dissolve a trigger guard and/or to trip an activation trigger device; and/or Sensing fluid flow rate and/or pressure drop across the validation assembly, and triggering said camera assembly when said flow rate and/or pressure drop reaches a predetermined value.

The validation tool of the present invention operates best in optically clear, moving fluid, while a lens or port window to a camera sensor operates best when free of debris adjacent to fluid flow. Thus, the lens/port window of the present invention can be beneficially maintained in clean condition when the validation tool of the present invention is activated and begins recording. In a preferred embodiment, at least one fluid flow port is positioned at or near a lens in order to direct fluid flow at or over the lens/port window of the camera sensor(s). Fluid flow, which can be driven by movement of pipe (swabbing effects considered) or via pumping methods, helps to keep said lens(es) and/or port window(s) clean and substantially free of debris. It is to be observed that passive lens/port window fluid flow cleaning may take place before or during tool activation, and that such lens(es)/port window(s) may be coated in a surfactant or other material to lower surface tension (or interfacial tension) at said location in order to assist in passive cleaning thereof.

After video data has been recorded and stored within the memory of validation tool 100, it can be transferred to a computer having a data processor for viewing and verification. Validation tool 100 provides multiple options for accomplishing this task:

Access to validation tool 100 on-board memory is accessible externally. A plug, sealed to the environment, may be removed to gain physical access to validation tool 100 on-board memory, allowing a user to bypass additional time required to download video log data. Alternatively, a user can remove a memory card from validation tool 100, connect it to a computer having a processor (PC/Laptop), and view the recorded video directly.

Wireless data transmission using, but not limited to, 802.11 or Bluetooth technology.

Direct connection and transmission through cable from a micro-processor (PC/Laptop) to validation tool 100.

Data may be identically duplicated for integrity within the tool using a RAID array or similar type structure.

Duplicated data acts as a safety measure for assured data retention.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

The invention claimed is:

1. A method of validating conditions in a wellbore comprising:

a) installing at least one camera assembly in a tubular workstring, wherein said camera assembly further comprises:

i) a body member having a central through bore, an outer surface and at least one recess in said outer surface;

ii) a camera mounted within said at least one recess;

b) conveying said camera assembly into said wellbore via said tubular workstring;

c) performing cleanout operations in said wellbore by circulating fluid through said tubular workstring;

d) selectively activating said camera of said at least one camera assembly; and e) acquiring optical data using said camera of said at least one camera assembly.

2. The method of claim 1, further comprising retrieving said at least one camera assembly from said wellbore.

3. The method of claim 1, further comprising at least one mirror, wherein said camera is focused on an image of said wellbore reflected in said at least one mirror.

4. The method of claim 1, wherein said optical data comprises visual images depicting fluid in said wellbore.

5. The method of claim 4, wherein said visual images comprise a substantially 360 degree view within said wellbore.

6. The method of claim 1, wherein said step of activating said camera assembly comprises:

a) placing a ball or other object on a seat; and b) applying fluid pressure above said ball or other object.

7. The method of claim 1, wherein said step of activating said camera assembly comprises:

a) passing an RFID chip in proximity to said camera assembly; and b) sensing said RFID chip as it passes said camera assembly.

8. The method of claim 1, wherein said step of activating said camera assembly comprises:

a) providing a plurality of conductive points;

b) pumping a conductive fluid to contact said conductive points and complete an electrical circuit.

9. The method of claim 1, wherein said step of activating said camera assembly comprises manipulating an activation switch using an activation device conveyed via wireline.

10. The method of claim 1, wherein said step of activating said camera assembly comprises triggering said activation using acid or corrosive fluid.

11. The method of claim 1, wherein said step of activating said camera assembly comprises sensing a pre-determined fluid flow rate or pressure drop across said camera assembly.

12. A tubular-conveyed camera assembly comprising:

a) a body member having a central through bore, an outer surface and at least one recess in said outer surface, wherein said body member is installed within a tubular workstring;

b) a camera mounted within said at least one recess;

c) a battery for powering said camera; and d) a memory device for saving data recorded by said camera.

13. The camera assembly of claim 12, further comprising at least one mirror, wherein said camera is focused on said mirror.

14. The camera assembly of claim 13, wherein said mirror reflects a portion of said wellbore.

15. A method of validating conditions in a wellbore comprising:

a) installing at least one camera assembly in a tubular workstring, wherein said camera assembly further comprises:

i) a body member having a central through bore, an outer surface and at least one recess in said outer surface;

ii) a camera mounted within said at least one recess;

b) conveying said camera assembly into said wellbore via said tubular workstring;

c) performing cleanout operations in said wellbore using said tubular workstring;

d) selectively activating said camera of said at least one camera assembly;

e) acquiring visual images of said wellbore using said camera of said at least one camera assembly;

f) using said visual images to evaluate effectiveness of said cleanout operations.

16. The method of claim 15, further comprising retrieving said at least one camera assembly from said wellbore.

17. The method of claim 15, wherein said visual images comprise a substantially 360 degree view within said wellbore.

* * * * *